United States Patent [19]

Balassa

[11] Patent Number: 4,705,466

[45] Date of Patent: Nov. 10, 1987

[54] METHOD AND APPARATUS FOR PRODUCING ROLLED PRODUCT FROM METAL DROPLETS

[76] Inventor: Oscar Balassa, 38 Dettman Avenue, Longueville 2066, Australia

[21] Appl. No.: 809,565

[22] Filed: Dec. 16, 1985

Related U.S. Application Data

[63] Continuation-in-part of Ser. No. 626,873, Jun. 21, 1984.

[51] Int. Cl.[4] ..... B22F 3/18

[52] U.S. Cl. ..... 425/6; 425/79; 164/417; 164/428; 29/527.7; 419/3; 419/50; 264/6; 264/13; 264/14; 75/0.5 BA

[58] Field of Search ..... 419/3, 50; 29/527.7; 264/6, 13, 14; 164/417, 428, 476, 477, 480, 466, 475; 425/8, 79; 75/0.5 BA

[56] References Cited

U.S. PATENT DOCUMENTS

| | | | |
|---|---|---|---|
| 2,113,280 | 4/1938 | Olin et al. | 264/14 |
| 2,510,574 | 6/1950 | Greenhalgh | 264/9 |
| 2,528,407 | 10/1950 | Yeandle | 23/302 R |
| 2,738,548 | 3/1956 | Kassel | 264/14 |
| 3,123,855 | 3/1964 | Fischer et al. | 425/6 |
| 3,270,409 | 9/1966 | Grant | 419/50 X |
| 3,334,408 | 8/1967 | Ayers | 419/50 X |
| 3,359,100 | 12/1967 | Claus et al. | 419/50 X |
| 3,368,273 | 2/1968 | Maltsev et al. | 164/474 |
| 3,533,782 | 10/1970 | Claus et al. | 419/3 |
| 4,114,251 | 9/1978 | Southern et al. | 419/50 X |
| 4,354,987 | 10/1982 | Iya | 264/13 |

FOREIGN PATENT DOCUMENTS

| | | | |
|---|---|---|---|
| 149281 | 12/1952 | Australia | 425/6 |
| 456654 | 6/1972 | Australia | 425/7 |
| 456695 | 6/1972 | Australia | 425/7 |
| 1091101 | 11/1967 | United Kingdom | 75/0.5 R |
| 1222262 | 2/1971 | United Kingdom | 419/6 |

OTHER PUBLICATIONS

Grant, N. J., "Rapid Solidification of Metallic Particulates", *J. of Metals,* 35(1) (1983, Jan.), pp. 20–27.

USSR 151,279, Abstract in English from *Soviet Inventions Illustrated,* (1965).

USSR 250,095, Abstract in English from *Soviet Inventions Illustrated,* (May 1970).

*Primary Examiner*—John F. Terapane

*Assistant Examiner*—Matthew A. Thexton

*Attorney, Agent, or Firm*—Ladas & Parry

[57] ABSTRACT

A method and apparatus for continuous processing of metal between molten and bright hot rolled stages includes the production of uniform liquid metal droplets at the top of a shot tower containing inert gas, forming and maintaining columns of closely spaced but separate metal droplets, retarding the flow of said droplets to a slow, substantially constant, velocity and cooling the droplets principally by radiation to at least partial solidification, collecting the at least partially solidified droplets in a bottomless receptacle in a weakly cohesive column, passing said column into the bite of a pair of mill rolls, rolling the said column into a rolled product, and cooling the rolled product by arc contact with off-set colling/flatening rolls and by radiation and convection cooling in an inert gas.

14 Claims, 2 Drawing Figures

METHOD AND APPARATUS FOR PRODUCING ROLLED PRODUCT FROM METAL DROPLETS

This is a continuation-in-part of Ser. No. 626,873 filed on June 21, 1984, international application PCT/AU83/00158 filed on Oct. 28, 1983, which designated the U.S.

The present invention relates to large scale continuous processing of ferrous and non-ferrous metals between the molten and bright hot rolled stages.

BACKGROUND ART

Conventional processing of molten metals such as steel requires the use of much heavy equipment which is very expensive both to install and to operate. In order to produce a 3 mm thick rolled steel sheet for example, the molten steel is continuously cast into a water-cooled bottomless copper mould of a continuous casting equipment and continously withdrawn therefrom in the form of slab approximately 250 mm thick. After withdrawal the slab—still containing a liquid core—is further cooled by water-spray, then air cooled, bent to horizontal and cut to length. The solidification of molten steel begins at the outer surface of the slab at a fast rate and progresses towards the centre at a gradually reduced speed. This typical pattern of solidification produces a heterogenous crystal structure and segregation which is undesirable. At the same time, stresses develop due to shrinkage of the surface and can produce cracks which may lead to the rejection of the semi-finished or finished product. The slab may have other surface defects as well which are removed by flame or mechanical scarfing. The slab then is transferred into a continuous slab reheating furnace to be reheated to the required uniform rolling temperature. By the time the slab is discharged from the furnace it is covered with hard thick scale—a mixture of ferrous oxides—which is removed by a hydraulic scale breaker prior to rolling which is the next major step in the processing line. The descaling operation is repeated at least once more during the long rolling operation. The large thickness difference between the cast slab and the rolled sheet is not desirable but necessary in order to reduce mould wear/tonne slab produced and also to reduce scarfing and scale losses. The large reduction between the slab and the sheet requires several separate reduction steps, thus a continuous hot strip mill line contains about twelve rolling mills. The average mass of a mill may approach 1000 tonne and the mill motor capacity 5000 KW. In the rolling mill line are incorporated several hundred heavy transfer rollers, which are all driven, the majority of them individually. Much other heavy equipment is used for handling and transferring the slab and sheet between operations. After the rolled sheet passes the last mill, it is wound into a coil and transferred to a continuous pickling line, whereat it is de-coiled, guided to form several long horizontal loops of variable length, passed through hot hydrochloric acid baths, cold water-spray, post treatment tank, rinse tank, hot air dryer and a set of loops again to produce a semi-bright hot rolled sheet ready for cold rolling or surface treatment like galvanising or painting. A further complex and costly apparatus is needed for reclaiming the spent hydrochloric acid, or an equally costly system for the disposal of it. The apparatus for processing steel as described above is regarded as a modern one, yet is still one of the most expensive of any kind of processing apparatus ever used.

Simplified method and apparatus for continuously casting and rolling metal have been disclosed in U.S. Pat. No. 3,368,273 of which the present applicant was a co-applicant. In the method of that patent, molten metal is formed into streams and droplets which are cooled in a liquefied cooling medium. However, the provision of the cooling liquid necessitates a complex, and expensive, structure. The heat sink capacity of solidified drops was envisaged to be inadequate to cool the liquid steel sufficiently to form a slab suitable for direct rolling; alternatively if only droplets were produced and rolled, sealing the liquid glass at the mill rolls could not practically be solved. For these reasons, the invention of U.S. Pat. No. 3,368,273 was never realised.

There are several patents directed to the production, cooling and rolling of atomised metal particles; the technology is commonly referred to as powder metallurgy processing. For example, U.S. Pat. No. 4,114,251 teaches a process which includes atomizing molten metal in an inert atmosphere, cooling the atomized particles and then rolling the particles to form an elongated metal article. However, the process described in that patent uses convection cooling; the process is unsuitable for radiation cooling due to the large mutual shielding effects of the relatively small, closely packed, particles. The inner particles close to the center of the powder stream would remain liquid in a heat radiating column of small particles. The use of baffle 20 also excludes the possibility of any significant radiation heat exchange. Thus, while known powder metallurgy methods are used in U.S. Pat. No. 4,114,251, such methods are unsuitable for high volume steel production.

U.S. Pat. No. 4,354,987 teaches the consolidation of very fine silicon powder into shotted form. The droplets are cooled by convection in a cooling gas. The specification states: "The degree of solidification is a function of the heat transfer characteristics of the gas within the cooling tower" (ref. specification, col. 5, lines 32 to 34). In an indirect way this teches against any significant radiation heat loss. While the cooling method is suitable for silicon shot production of a relatively low throughput, the method again is unsuitable for high volume steel production.

The rate of convention cooling can be increased by increasing the velocity of the counter current gas. However, the velocity of the counter current gas must be limited to avoid exaustion, i.e. if the velocity is too great, the particles would be blown upwards. Similarly, the throughput could be increased by increasing the diameter of the cooling tower. However, it is advantageous to use a small bite angle on the roles at the bottom of the cooling tower in order to maintain substantially constant flow and to avoid arching and consequent local stopping of flow, excessive accumulation of particles and forced interuption of the process. Thus, the bite angle limits the gas flow and the size of the width of the cooling tower. In practice, the cooling tower cannot be increased effectively beyond the bite angle.

In order to obtain a practicable method and apparatus of processing metal in large commercial quantities, the metal droplets must be cooled at a high rate. With convection cooling, heat is lost from the metal droplets to the surrounding gas. However, the temperature of the surrounding gas quickly approaches the temperature of the metal droplets. The cooling gas has low thermal capacity. As the temperature differential decreases, the rate of convection cooling drops accordingly. Thus, convection cooling is effective only for a relatively short period of time when the gas first enters the cooling tower, or for powder metallurgy where the relatively small amounts of heat in the powder particles can be dissipated by convection. Unlike prior art methods, the present invention uses predominantly radiation cooling to achieve satisfactory cooling of metal droplets on a large commercial scale, typically one million tons per year or more.

SUMMARY OF THE INVENTION

It is an object of the present invention to provide a method and apparatus for high throughput processing of ferrous and non-ferrous metals between the molten and bright hot rolled stages.

A more particular object is to provide a method and apparatus which enables the molten metal to be processed without requiring slab casting, slab bending, scarfing, reheating, descaling, acid pickling or sandblasting (over 5 mm thickness).

A still more particular object is to provide a method and apparatus which enables the molten metal to be processed to final product by using much less power for rolling and a fewer rolling mills.

In one broad form, the present invention provides a method of continuously processing metal including the production of at least partially solidified metal droplets suitable for direct rolling into a rolled product, said method comprising the steps of passing molten metal through a trough having a perforated bottom to form streams of substantially uniform droplets in a cooling tower under said trough, retarding the downward flow of said droplets to a substantially constant velocity and cooling said droplets principally by radiation in a cooling tower containing inert gas.

Preferably, the descent velocity is slowed to between 0.1 and 5.0 meters per second, and typically between 1.0 and 2.0 meters/second.

The droplets can be retarded by any suitable means, for example an opposed electromagnetic field or a counter current of inert gas.

The invention also provides apparatus for continuously processing metal including the production of at least partially solidified droplets ready for direct rolling into rolled product, said apparatus comprising a trough for receiving molten metal, said trough having a perforated bottom to permit passage of the molten metal therethrough to form streams of droplets, a cooling tower under said trough through which said droplets fall, and means for retarding the downward flow of said droplets to a substantially constant velocity, whereby said droplets are cooled principally be radiation.

DESCRIPTION OF PREFERRED EMBODIMENT

Figure 1:
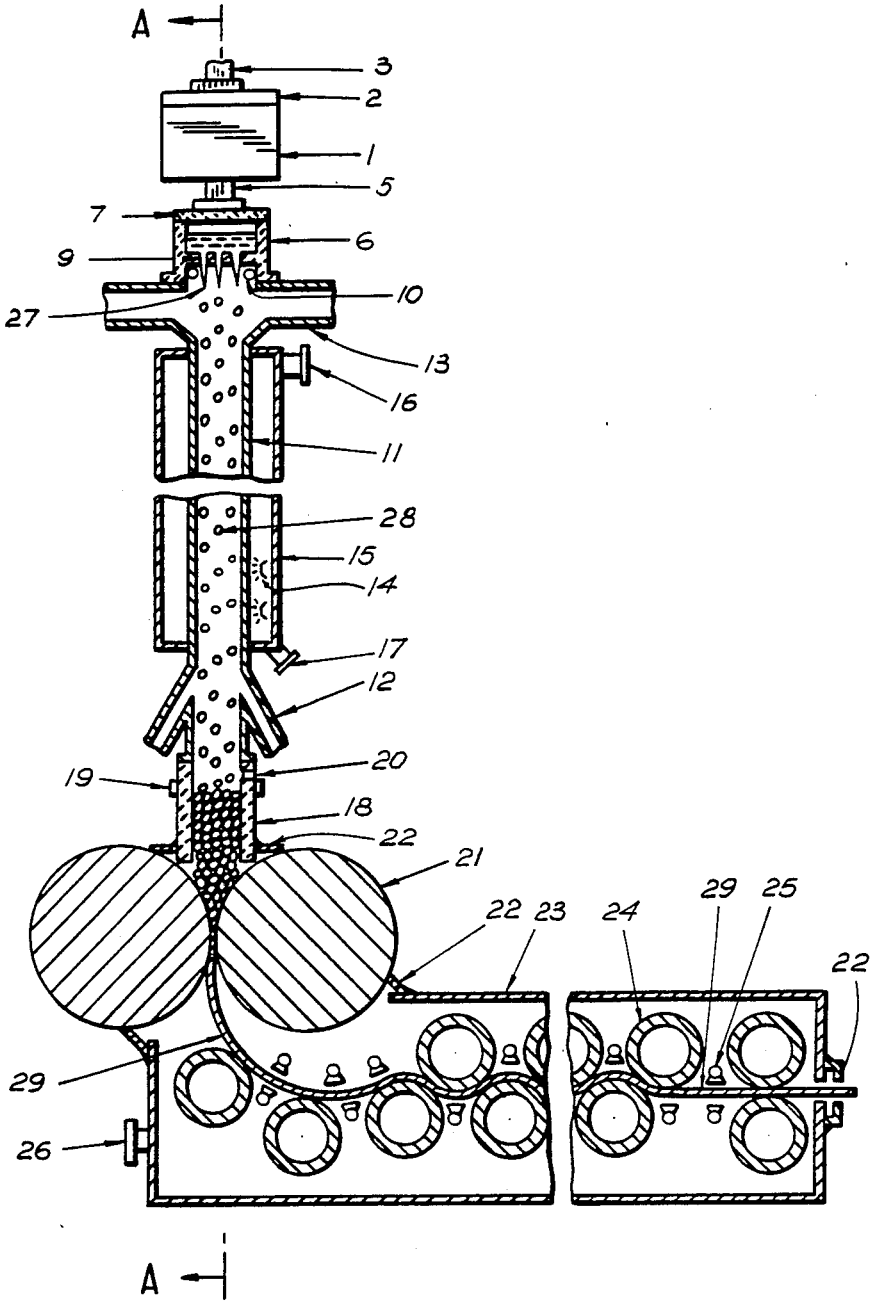
Figure 2:
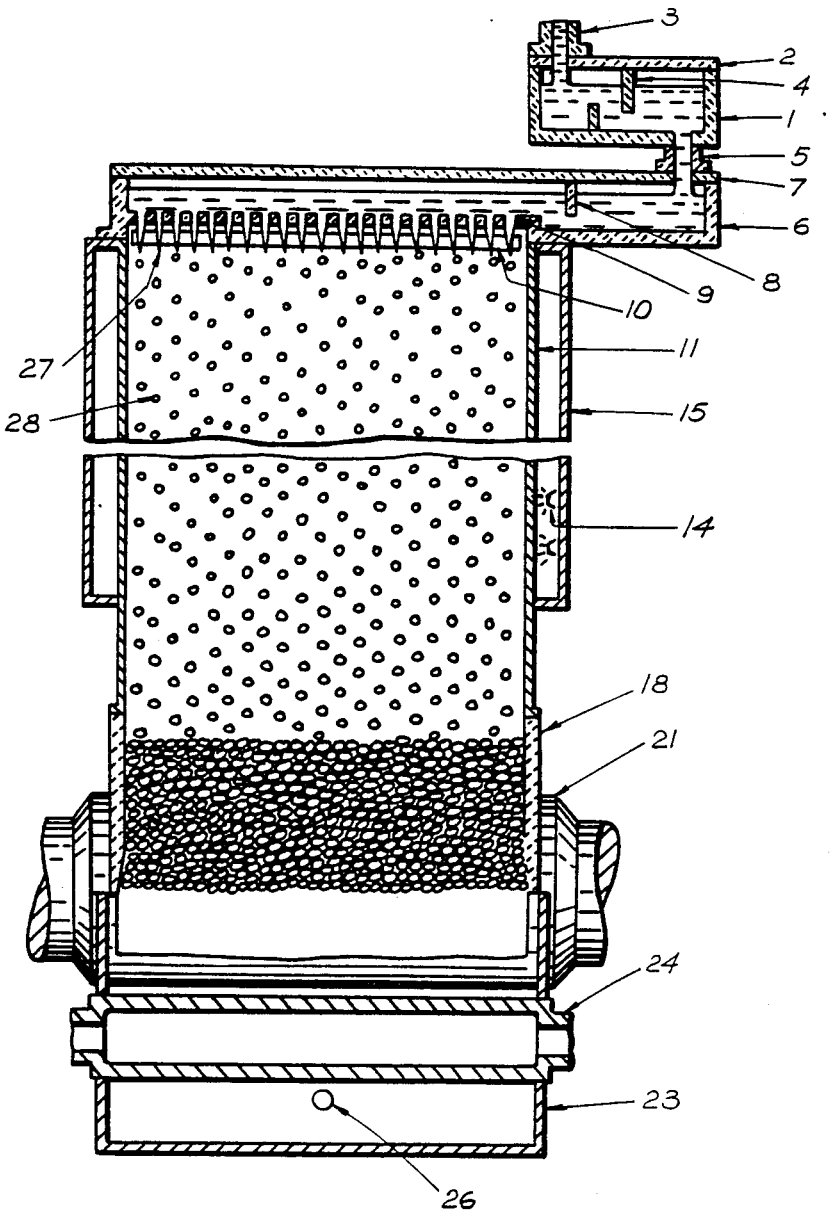

An embodiment of the present invention will now be more particularly described with reference to the accompanying drawings, in which:

FIG. 1 is a sectional side-elevational view of the apparatus of the preferred embodiment; and FIG. 2 is a sectional view through the line A—A of FIG. 1.

As shown in FIGS. 1 and 2, the apparatus comprises a refractory tundish 1 which is covered with a refractory lid 2 in order to reduce heat losses and to exclude the oxidising air. One or more inlets 3 through the lid 2 receive a supply of molten metal at a regulated rate from a suitable source thereof (not shown), and a slag retaining wall 4 is provided within the tundish 1. In the base of the tundish 1 there is one or more outlet openings 5 equipped with means [e.g. gate valve(s)] for controlling discharge rate of molten metal.

Mounted beneath the tundish 1 is a refractory trough 6 with a refractory lid 7 which has inlet opening(s) in line with the outlet opening(s) 5 in the base of tundish 1 for receiving molten metal supply therefrom. The trough 6 is divided into two distinct regions i.e. a shorter and deeper inlet section and a longer and shallower outlet section as shown in FIG. 2. Impurities, mostly oxide materials in the molten metal are retained in the said inlet section by a skimming wall 8, and are periodically removed therefrom. In the base of the outlet section of trough 6 there are provided a large number of small holes 9 preferably from 1 to 6 mm in diameter for discharging the molten metal in the form of small streams 27 which break up and form substantially uniform droplets 28. Heaters 10 are provided along the outlet section of the trough 6 in order to prevent blocking of the discharge holes 9 by locally solidifying metal. Such heaters can be graphite resistor radiant heaters.

Joined to the base of trough 6 is an upright cooling duct 11 for receiving the molten metal droplets 28. In order to reduce the mutual radiation shielding effect of the droplets, one or more vertical cooling panels parallel to the longitudinal sides of the cooling duct can be used to divide the duct into two or more narrower ducts. These cooling panels may be formed by closely spaced water pipes. The duct 11 is continuously charged with recirculated inert gas through inlet 12 and discharged through gas outlet 13 creating an upward flow of gas in the duct 11 countercurrent to the flow of the metal droplets 28. The gas outlet 13 leads to a gas cleaning/cooling chamber (not shown), followed by a gas compressor (not shown), gas pressure vessel (not shown), gas flow regulating valve(s) (not shown) and gas inlet 12, completing the recirculating cycle. The duct 11 is cooled from outside by water sprays 14 which are housed in a spray cooling chamber 15, the latter being equipped with vapour exhaust 16 at the top and water drain 17 at the bottom. Alternative cooling means e.g. ducted water, air cooling can also be used.

The principal function of the countercurrent of inert gas is not to cool the droplets by convection, but to slow down the droplets to a substantially uniform velocity. Since the downward acceleration of the droplets is retarded by the countercurrent of gas, the droplets spend more time in the cooling tower and hence more heat is lost by radiation. At least half the heat loss is by radiation. It has been found that the rate of heat loss by radiation is proportional to the fourth power of the absolute temperature. The droplets are slowed to a velocity between 0.1 and 5.0 meters/second, and preferably between 1 and 2 meters per second.

A countercurrent of gas is used to retard the gravitational acceleration of the droplets since the gas is relatively easy to handle and direct. However, other retardant methods may be used. For example, an opposing electromagnetic field may be created in the cooling duct. Such an electromagnetic field may be created by appropriate coils surrounding the cooling duct.

At the lower end of duct 11 there is mounted a refractory receptacle 18 open at the top and bottom for collecting the the metal droplets 28 which are partly or fully solidified due to heat loss mainly by radiation and partly by convection while falling through cooling duct 11. Near the top of receptacle 18 there is provided a level control instrument 19 for automatic adjustment of the speed of reduction rolls 21 through a servo-mechanism. Above the top level of collected metal in the receptacle 18 there are mounted one or more pyrometers 20 for automatic control of the temperature of said metal by adjusting the period of time of radiation by varying the velocity of the recirculating inert gas through a servo-mechanism.

At the bottom end of receptacle 18 there is provided a pair of reduction rolls 21 for supporting, withdrawing, cooling, compacting and rolling the droplets 28 to a sheet 29. Between the rolls 21 and the receptacle 18 there are mounted self-adjusting seals 22 to prevent air entry into the receptacle 18 and the rolling region. In order to achieve the optimum use of a single apparatus, i.e. to enable it to produce flat products of various thicknesses, the gap between the rollers 21 is adjustable. In order to produce a strip of final thickness by a single rolling pass an optimum ratio between the inside width of receptacle 18 and the thickness of the finished sheet 30 is desirable. This is achieved by making the gap between the sides of receptacle 18 parallel to the rolls 21 adjustable. In order to preserve a rolling symmetry, both rolls 21 should be moved equally inwards (towards the centre) or outwards, so should the said walls of the receptacle 18. These adjustments are carried out similarly to conventional mill rolls i.e. by a so-called screw-down mechanism modified for horizontal double action.

An elongated horizontal cooling chamber 23 is provided, one of its ends directly underneath the rolls 21, open at the top for receiving the rolled sheet 29. Inside the chamber 23 there are mounted internally water-cooled driven rolls 24 for guiding, cooling and flattening the rolled sheet 29. The rolls 24 are off-set to provide an arc contact with the product to ensure a large cooling surface area. The chamber 23 is charged with circulating inert gas through blowers 25 which are positioned for effectively cooling the sheet 29. A gas outlet 26 is provided on the chamber 23. From the outlet 26, the gas passes through a cooling chamber, compressor, gas pressure vessel and gas flow adjusting valve (neither shown), and to inlet blowers 25, thus forming a gas recirculating system. Self-adjusting seals 22 are provided between the rolls 21 and chamber 23 (same as used between rolls 21 and receptacle 18). Another self-adjusting seal 22 is mounted on the rolled sheet outlet end of the chamber 23 for enabling the sheet to leave the chamber 23 without letting in oxidising air. The rolled product should be cooled down to below a temperature which would cause quick oxidation in the open air.

The operation and control of the above-described apparatus will now be described in relation to the processing of molten steel into bright hot rolled sheet, it being understood however that this particular metal and form is merely given by way of illustration and that other molten metal can be processed and different rolled shapes can be produced by the method and apparatus of the invention.

Vacuum degassed molten steel of conventional or higher pouring temperature is continuously supplied to tundish 1 through inlet(s) 3 and discharged through opening(s) 5 into trough 6, from where it is discharged through perforations 9 in its base into cooling duct 11. The tundish 1 and trough 6 are preheated to higher than conventional tundish preheat temperature. The trough 6 is preferably preheated to not less than the solidification temperature of the steel cast. The main controlling parameter of the casting rate is the length of the continuous molten steel streams 27 (prior to being formed into droplets 28) which should be not longer than 100 mm and preferably less than 50 mm. This should be either continuously monitored by an operator who adjusts the output rate from the tundish 1 accordingly, or a suitable automatic control is used. The streams 27 break up and form droplets 28. The cooling duct 11 is charged with a recirculating inert gas (e.g. argon) in such a way that an upward flow is maintained countercurrent to the downward flow of the steel droplets 28. The velocity of droplets 28 and the radiation cooling time the droplets 28 spend in duct 11 (and hence their temperature reduction) are regulated by the velocity of the inert gas. The countercurrent velocity is chosen so that the droplets are slowed to a substantially constant velocity, between 0.1 and 5.0 meters per second and typically between 1 and 2 meters/second. This increases the time spent in the cooling duct and hence the heat loss by radiation. Unlike convection cooling which is limited by both the inlet and outlet temperatures of the gas and the flow rate, radiation cooling is limited essentially by time only.

A number of pyrometers 20 at the top of receptacle 18 where the droplets 28 are collected measure the temperature of the droplets 28, and the gas velocity is adjusted to ensure that the temperature of droplets 28 is with predetermined limits. For example, if the droplets have not cooled sufficiently, the gas velocity is increased to slow the droplets further to increase the radiation heat loss. A rolling temperature much higher than the conventional one is practicable because, in the absence of oxygen, there is no risk of "burning" of the steel. The upper limit of the rolling temperature may approach the lower limit of solidification of the steel being processed provided that the rolled product 30 has enough strength and stiffness for further processing as it leaves the reduction rolls 21. The required level of collected droplets 28 in the receptacle is maintained by automatic speed control of rolls 21 by a level control instrument 19 near the top of receptacle 18 and a connected servo-mechanism (not shown).

The steel is not to be contaminated by oxides, and therefore no air, vapour or gas other than the inert cooling gas must come into contact with the steel during processing i.e. between pouring and the point the steel leaves the horizontal cooling chamber 23.

In order to ensure this, both the vertical cooling duct and the horizontal cooling chamber are thoroughly purged and the air displaced by the inert gas prior to starting the processing, and the inert gas pressure is maintained higher than the ambient atmospheric pressure.

At the commencement of the operation the reduction rolls 21 are hard against each other. They start the rolling action within 1 to 2 seconds after the pouring begins with no roll gap, rapidly opening to the required product thickness. Thus the first one meter or so of rolled length has a wedge shape and is discarded after filling the useful role of a self-created dummy bar.

The apparatus of the present invention has the great advantage of eliminating much of the apparatus presently used in conventional steel making processes thereby resulting in (1) a much smaller space requirement for a plant of a given capacity (the length of present processing route is reduced from about 2000 meters to less than 100 meters), (2) lower capital cost and (3) smaller operating labour cost. The power requirements are also considerably reduced by the elimination of reheating furnaces, scarfing, descaling etc. plant, while the rolling expenses are reduced to a minimum since this process requires only a small reduction ratio and the rolling takes place while the steel is in a more plastic state than with presently used equipment. There is also a complete elimination of losses due to scarfing, descaling and pickling and an absence of reject due to various defects in slabs as produced in conventional processing of steel. The use of acid as used in the conventional pickling process is completely eliminated making the method and apparatus of the present invention environmentally much more acceptable. Segregation present in conventionally processed material is eliminated by the new process because segregation within a solidified droplet is entirely negligible. Consequently, the material has increased tensile strength normal to the rolling plane. The product has a clean metal surface ready for cold rolling or for application of a protective coating without any preparation.

The foregoing describes only one embodiment of the present invention, and modifications which are obvious to those skilled in the art may be made thereto without departing from the scope of the invention as defined in the following claims.

The claims defining the invention are as follows:

1. A method of continuously processing metal including the production of at least partially solidified metal droplets suitable for direct rolling into a rolled product, said method comprising the steps of passing molten metal through a trough having a perforated bottom to form streams of substantially uniform droplets in a cooling tower under said trough, retarding the downward flow of said droplets to a substantially constant velocity and cooling said droplets principally by radiation in a cooling tower containing inert gas.

2. A method as claimed in claim 1 wherein the descent velocity of said droplets is retarded to between 0.1 and 5.0 meters/second.

3. A method as claimed in claim 2, wherein the descent velocity of said droplets is between 1.0 and 2.0 meters/second.

4. A method as claimed in claim 1 wherein the downward flow of said droplets is retarded by a countercurrent recirculating inert gas.

5. A method as claimed in claim 4 wherein the at least partially solidified drops are collected in a weakly cohesive column in a bottomless receptacle, comprising the further steps of passing said column by gravitation into the bite of a pair of mill rolls, and rolling said column of at least partially solidified droplets into a bright hot rolled product.

6. A method as claimed in claim 5, further comprising the steps of passing the rolled product into a cooling chamber having recirculating inert cooling gas therein, the pressure of the inert gas in said cooling chamber being maintained above atmospheric pressure, passing the rolled product between off-set cooled rolls in said cooling chamber, cooling the rolled product by arc contact with said cooled rolls and by radiation and convection cooling while simultaneously flattening the rolled product by said cooled rolls, and discharging the cooled rolled product at a temperature low enough to prevent oxidation in air.

7. Apparatus for continuously processing metal including the production of at least partially solidified droplets ready for direct rolling into rolled product, said apparatus comprising a trough for receiving molten metal, said trough having a perforated bottom to permit passage of the molten metal therethrough to form streams of droplets, a cooling tower under said trough through which said droplets fall, and means for retarding the downward flow of said droplets to a substantially constant velocity, whereby said droplets are cooled principally be radiation.

8. Apparatus as claimed in claim 7, wherein said retarding means comprises means providing a countercurrent of recirculated inert gas in said cooling tower.

9. Apparatus as claimed in claim 8, further comprising tundish means having an inlet for receiving molten metal, and at least one controllable outlet for discharging molten metal into said trough, said trough having a deeper inlet section and a shallower outlet section, the outlet section containing a plurality of outlet holes in the base thereof.

10. Apparatus as claimed in claim 9, wherein said holes have a diameter of not less than 1 mm and not more than 6 mm.

11. Apparatus as claimed in claim 8 further comprising means for maintaining the pressure of inert gas in said cooling tower above ambient atmospheric pressure, and waterspray means for cooling said cooling tower.

12. Apparatus as claimed in claim 11 further comprising bottomless receptacle means at the bottom of said cooling tower for collecting said droplets in a weakly cohesive column after at least partial solidification during passage through said cooling tower, and roller means for rolling the collected solidified droplets into a bright hot rolled product.

13. Apparatus as claimed in claim 12, further comprising a cooling chamber for receiving the rolled product from said roller means, said cooling chamber having recirculating inert cooling gas maintained at a pressure greater than ambient atmospheric pressure, and cooled roller means for cooling and flattening said rolled product.

14. Apparatus as claimed in claim 11, wherein said roller means comprises a pair of reduction rolls having an adjustable gap therebetween.

* * * * *

UNITED STATES PATENT AND TRADEMARK OFFICE

CERTIFICATE OF CORRECTION

PATENT NO. : 4,705,466

DATED : November 10, 1987

INVENTOR(S) : Oscar Balassa

It is certified that error appears in the above-identified patent and that said Letters Patent is hereby corrected as shown below:

On the title page, insert priority from PCT/AU83/00158, filed October 28, 1983, and Australian Application PF 6561, filed October 28, 1982.

Signed and Sealed this

Seventeenth Day of May, 1988

*Attest:*

DONALD J. QUIGG

*Attesting Officer*

*Commissioner of Patents and Trademarks*